US010308388B2

(12) United States Patent
Kasarin et al.

(10) Patent No.: US 10,308,388 B2
(45) Date of Patent: Jun. 4, 2019

(54) METHOD AND DEVICE FOR PROCESSING BEVERAGE CONTAINERS

(71) Applicant: KRONES AG, Neutraubling (DE)

(72) Inventors: Alexander Kasarin, Woerth (DE); Armin Pueschner, Regensburg (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 15/740,022

(22) PCT Filed: Nov. 7, 2016

(86) PCT No.: PCT/EP2016/076792
§ 371 (c)(1),
(2) Date: Dec. 27, 2017

(87) PCT Pub. No.: WO2017/077101
PCT Pub. Date: May 11, 2017

(65) Prior Publication Data

US 2018/0186497 A1 Jul. 5, 2018

(30) Foreign Application Priority Data

Nov. 5, 2015 (DE) ..... 10 2015 119 023

(51) Int. Cl.

| | |
|---|---|
| ***B65C 9/42*** | (2006.01) |
| ***B67C 3/00*** | (2006.01) |
| ***B65B 57/20*** | (2006.01) |
| ***B65C 9/26*** | (2006.01) |
| *B65C 3/12* | (2006.01) |
| *B65C 9/10* | (2006.01) |

(52) U.S. Cl.
CPC ..... *B65C 9/42* (2013.01); *B65B 57/20* (2013.01); *B65C 9/26* (2013.01); *B67C 3/007* (2013.01); *B65C 3/12* (2013.01); *B65C 9/105* (2013.01)

(58) Field of Classification Search
CPC .. B65C 1/00; B65C 1/021; B65C 3/12; B65C 9/08; B65C 9/105; B65C 9/26; B65C 9/36; B65C 9/40; B65C 9/42; B65C 9/46; B65C 2009/0093; B65C 2009/402; B65C 2009/404; B65C 2009/405; B65C 2009/407; B65C 2009/408; B67C 3/007
USPC ..... 156/360, 366, 367, 368, 538, 539, 156/DIG. 2, DIG. 3, DIG. 4, DIG. 27, 156/DIG. 42, DIG. 45, DIG. 47; 700/213
See application file for complete search history.

(56) References Cited

U.S. PATENT DOCUMENTS

2007/0209753 A1 9/2007 Gonzalez et al.

FOREIGN PATENT DOCUMENTS

| | | | |
|---|---|---|---|
| DE | 102008037708 | A1 | 2/2010 |
| DE | 102012021997 | A1 | 5/2014 |
| DE | 102014105034 | A1 | 10/2015 |

(Continued)

OTHER PUBLICATIONS

International Search Report PCT/EP2016/076792, International Filing Date: Nov. 7, 2016.

*Primary Examiner* — George R Koch
(74) *Attorney, Agent, or Firm* — Schmeiser, Olsen & Watts, LLP

(57) ABSTRACT

Provided is a method and a device for processing containers, the containers being transported along a predefined transport path and being combined with at least one product that can be defined in terms of its amount, such that the product is supplied to each individual container in a predetermined supply region of the transport path, the product being guided to the supply region along a supply path.

11 Claims, 1 Drawing Sheet

(56) References Cited

FOREIGN PATENT DOCUMENTS

| | | | |
|---|---|---|---|
| EP | 2746202 | A1 | 6/2014 |
| WO | WO2010018224 | A1 | 2/2010 |

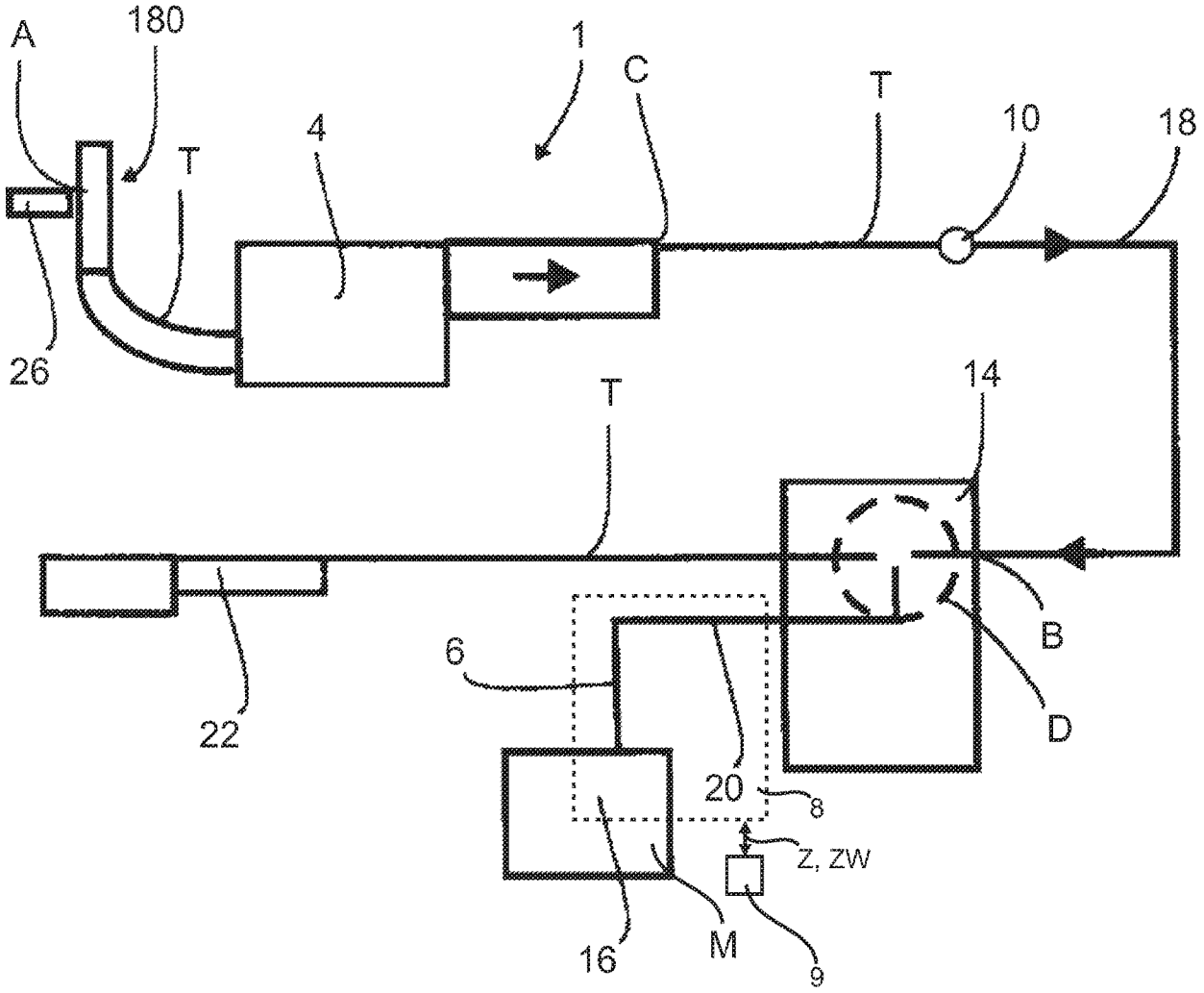
18
10
T
C
1
4
T
180
A
26
14
B
D
T
8
Z, ZW
9
20
M
16
6
22

METHOD AND DEVICE FOR PROCESSING BEVERAGE CONTAINERS

CROSS-REFERENCE TO RELATED APPLICATIONS

This application claims priority to PCT Application No. PCT/EP2016/076792, having a filing date of Nov. 7, 2016, based on German Application No. 10 2015 119 023.0, having a filing date of Nov. 5, 2015, the entire contents both of which are hereby incorporated by reference.

FIELD OF TECHNOLOGY

The following relates to a method for processing containers, and to a device for processing containers.

BACKGROUND

In the method described here for processing containers, the containers are transported along a predefined transport path and combined with at least one product that can be defined in terms of its amount, such that the product is supplied to each individual container in a predetermined supply region of the transport path, the product being guided to the supply region along a supply path. In this case, the "amount" variable refers to a weight, a volume, a number of pieces, and/or a length of the product.

Methods of this kind for processing containers are, however, well known in the known art, for example in DE 10 2008 037 708 B4. However, in the method known from the known art, the problem arises that losses in production time are incurred when there is a product changeover or also a roll changeover.

In order to carry out maintenance tasks of this kind on the machines so as to incur as little a loss in production time as possible, the individual magazines are deliberately made larger so as to minimize the number of such processes. It is also known to arrange different or similar kinds of magazine at a central location in order to centralize working tasks that may arise.

However, for this purpose it is necessary for the used transport units to accommodate large amounts or large numbers of pieces of the corresponding goods. Furthermore, in individual applications using mass transport units that change over automatically, such as rolls in magazines, it is known to carry out a changeover such that the fitting processes of mass transport units are additionally temporally shortened.

However, magazines or transport units of such a large size are problematic, in particular in the event of a production program changeover in the line, since large magazines or reservoirs in transport units have to be emptied at the end of the manufacturing process. This process takes a relatively long time, and it may be that the corresponding packaging materials and filling goods can no longer be used and are therefore considered scrap.

In order to solve this problem and in particular in order to facilitate, for example, a roll changeover such that changeover times may be kept as short as possible, the known art proposes, for example, the possibility of continuously determining the content of the containers, for example by means of a shift register in a device for processing, for example filling, containers. By the content of the containers being continuously determined, a conclusion can thus be drawn as to, for example, when and how many containers are still in the filling machine in order to be then labelled.

Furthermore, for example by an automatic control system comprising a display, it can be displayed to an operator, during production itself, from what time one of the rolls having the labels for the next product can be fitted once there are sufficient remaining labels available on the other roll.

Such a decision as to whether to pre-emptively fit the new roll having labels in advance is made, for example, on the basis of a stored number of labels on the particular roll or the roll to be fitted. Upon input of the number of remaining containers from a filling machine, the number of labels can therefore also be displayed. Accordingly, information can therefore be forwarded to the operator as to a forthcoming label and/or roll changeover. This can therefore be displayed as a message reading "labels for the next type can be provided", for example.

In this respect, only with the number of labels on the particular rolls as a basis for calculation has it previously been possible to carry out an early changeover of the labels. A decisive criterion for an early label changeover of this kind, so as to avoid having to interrupt the production process as far as possible and to deposit and apply labels on the bottles that are filled or are to be filled in a manner that is as continuous as possible, is therefore based to a significant degree on the predetermined value for the number of labels on the, preferably full, roll.

However, it has frequently been found that the predetermined number of labels on the roll, i.e. an expected value for the number of labels on the roll, may deviate from the actual number of labels on the roll. In the known art, this deviation has also previously been solved by the number of labels being checked and determined discretely or continuously over time by a sensor, a sensor system of this kind also having a high degree of error.

In particular, it has been found specifically that a process of this kind for determining a time from which it is possible to fit a new roll having labels on the basis of the input value (a number of labels, for example), which can only be determined roughly, is ridden with errors, and that this may also unsettle the operator when handling the machine.

SUMMARY

An aspect relates to reducing downtimes in a production changeover program on a line. A further aspect is to reduce the amount of scrap that is caused by a production program changeover.

In the method according to embodiments of the invention for processing containers, in a detection region, which is arranged along the supply path of the product or upstream of the supply region in a transport direction of the containers, at least one characteristic state which is individually determined prior to the processing and/or at least one further characteristic state are therefore determined or predefined, in particular by a detection unit, the characteristic state and/or further characteristic state being representative of an output fitting amount (of a number of labels predefined by the manufacturer, for example) of the product to be supplied in relation to at least one fitting device.

The detection region may cover the region between the fitting device and the supply region completely or in part. This may in particular mean that the detection region includes all or part of the supply path of the product. The diameter of a label roll, a film thickness and/or a length of labels, and/or a packaging film length, for example, could be detected in order to calculate therefrom the number of labels/amount of packaging film on the roll, for example.

In the process, a remaining amount of the product to be supplied, on the fitting device, is determined on the basis of the characteristic state and/or the further characteristic state during operation, a representative signal for a fitting changeover, in particular of the fitting device, being emitted on the basis of said remaining amount. The remaining amount may therefore be the amount of the product on or in the fitting device that results from the difference between the output fitting amount of a fitting device and the amount of product already supplied to the container.

The characteristic state may be, for example, the number of labels, which allows a clear conclusion to be drawn as to the output fitting amount of labels of this kind in relation to the particular roll, i.e. the fitting device in this case.

However, it is also possible for the characteristic state to be, for example, a number of containers which, in particular before a product changeover, are still to be processed or combined with the product. Furthermore, the characteristic state could be a filling state of a transport apparatus. Thus, at the start of a transport path, it could for example be established whether any further containers will arrive and thus whether only the containers in the transport path have to be processed. In this case, the characteristic state is based on a distinction as to whether or not there is a container at a particular point in the installation.

The characteristic state may also be, for example, a number of containers which—in particular before a product changeover (type changeover)—are still to be processed or combined with the product. Furthermore, the state could be a filling state of a transport apparatus. Thus, at the start of a transport path, it could be established, for example, whether any further containers will arrive and thus whether only the containers in the transport path have to be processed. In this case, the characteristic state is based on a distinction as to whether or not there is a container at a particular point in the installation.

Furthermore, a characteristic state could also be determined that is representative of an amount of the product, and a number of containers is determined on the basis of said characteristic state.

Furthermore, said characteristic state may also be predefined by the user or an automatic control system. Thus, for example, a container barrier can be closed, and further containers can thus be prevented from entering the transport path. In the case of block installations or installations in which the containers are guided piece-by-piece, said characteristic state is known from the outset or may be read out—for example from a memory apparatus.

However, according to embodiments of the invention, said characteristic state is in any case determined individually in each case, preferably by the detection unit, preferably before the actual processing of the containers, instead of being fixedly predefined, so as to therefore know in advance how many labels, for example, are in principle available for a labelling process, for example in relation to one label roll.

Since both the characteristic state and the further characteristic state can each be determined individually and preferably fully automatically, in particular by the detection unit, errors are therefore prevented, for example with respect to the output fitting amount of a label roll having the labels.

In this context, "fully automatically" means that the characteristic state can be determined without a machine user intervening. In this context, it is conceivable for the machine user to initiate the determination process before the start of the determination of the characteristic state and to merely carry out roll changeovers, for example.

In other words, each of the characteristic state and/or the further characteristic state being determined individually, each in relation to the specific label roll, for example in relation to a specific type, makes it possible for the particular characteristic states to be determined as accurately as possible, and this means that the burden on the operator is relieved to a quite considerable degree during the production process since the characteristic state is determined particularly accurately in contrast to the known art. This is because, if the characteristic state is known as accurately as possible, the time from which a further roll having labels or having a label strip can be fitted can be determined as precisely as possible.

In order to detect the amount, the detection unit may comprise at least one sensor that determines the amount of the product at predefined time intervals or even continuously over time. The sensor is in contact with an analysis and calculation module for data communication. Contact of this kind for data communication may be made wirelessly or in a wired manner. The analysis and calculation module thus analyses the amount data determined by the sensor.

According to at least one embodiment of the method for processing containers, the containers are transported along a predefined transport path and combined with at least one product that can be defined in terms of its amount, such that the product is supplied to each individual container in a predetermined supply region of the transport path, the product being guided to the supply region along a supply path.

According to embodiments of the invention, in a detection region, which is arranged along the supply path of the product or upstream of the supply region in a transport direction of the containers, at least one characteristic state which is individually determined prior to the processing and/or a further characteristic state is determined by a detection unit, which characteristic state and/or further characteristic state is representative of an output fitting amount of the product to be supplied in relation to at least one fitting device, and wherein a remaining amount of the product to be supplied, on the fitting device, being determined on the basis of said characteristic state and/or said further characteristic state during operation, and wherein a representative signal for a fitting changeover being emitted on the basis of said remaining amounts.

For example, the amount is determined taking into account a partial amount of the product located in the supply path. Here the amount of labels or closures, for example, that are located between a magazine for the product and the transfer region may be determined. Furthermore, the amount of a liquid product in a supply line between a tank and the filling region may also be determined.

Furthermore, the amount is preferably determined taking into account a number of containers between the detection region and the supply region, i.e. the transport path in said region. It is thus possible, for example, for an accumulation path in which a substantially particular number of containers is arranged to be arranged between the detection region and the supply region.

Taking into account said amount too, it can be established, for example, how many label pieces still have to be prepared so that, for example, the supply path for the product too can be largely cleared. In this way, the times for the product changeover can be minimized since an old label strip does not have to be removed from the supply region. In this way, it is also possible for the loss of label material to be reduced.

Therefore, for the method according to embodiments of the invention, time spent emptying the transport units and also possible losses of no longer usable materials are avoided.

In the case of mass transport units, such as rolls for packaging materials, the automatic changeover of fitting units can take place sufficiently timely that, at the end of the process, the next required type of material is in the machine and ready to be manipulated, i.e. for a subsequent line production program, for example. In this way, emptying time can also be avoided, and furthermore, time spent loading the new mass transport unit and a loss of material within the transport unit between the magazine and the location at which manipulation takes place in the machine can also be avoided. The mentioned amount is preferably a remaining amount of the product. On the basis of the characteristic number, it is therefore determined what amount of product is still required to adequately fit a particular margin.

Furthermore, it would also be possible to fit the containers with different products, for example with labels or with closures, so as to use the method according to embodiments of the invention for the two products, i.e. for both the labels and the closures and optionally also for a product to be filled in. The product may also be a packaging film.

The containers are advantageously selected from a group of containers that includes plastics bottles, glass bottles, preforms, tubes, cartons, beverage crates, pallet carriers and the like. This means that, by definition, the containers do not necessarily have to be sealed in a liquid-tight manner. In the case of beverage crates, it would be possible, for example, to put together beverage crates stocked with containers to form palettes, it being possible, in this case, for the products to be intermediate layers or palette carriers for palettes of this kind, for example.

According to at least one embodiment, the characteristic state is determined by the detection unit such that initially, during a determination process, the total amount of the previously produced product for a predefinable number of fitting devices is determined, and a mathematical average of the amount of the product produced per fitting device is subsequently determined in order to thus obtain an output fitting amount per fitting device, and the total amount being determined from a sum of sub-characteristic states of the individual fitting devices. In particular, the output fitting amount may be a starting amount of labels on a new roll.

The mathematical average may be an arithmetic mean in which each of the individual amount values are mathematically equally weighted. However, alternatively the mathematical average may also be a median, geometric mean, harmonic mean, quadratic mean or cubic mean. Further alternatively, it is also conceivable for the mathematical average to be formed such that one or more determined amount values are incorporated into the determination of the mathematical average so as to have a lesser or greater weighting than other amount values. In this case, it is conceivable, for example, for the first amount value or another non-total number of the amount values to be incorporated into the average so as to have a lesser weighting than the other amount values. This could minimize as far as possible the influence of measurement inaccuracies on the average that are initially still present.

Furthermore, the particular sub-characteristic states may be a value that is determined on the basis of a number of labels and/or a length of labels per label roll.

However, since the actual number of labels, in particular the output fitting amount, of the label roll may vary during a production process, a predetermined number of various label rolls is initially placed into a corresponding device, for example a device for processing containers, in order to initially determine, for each roll, a sub-characteristic state which can be uniquely assigned to the roll, preferably in a manner corresponding one-to-one.

If a predefined number of various sub-characteristic states is reached and a predefinable number of rolls, for example, has thus been covered, said individual sub characteristic states are preferably added to one another and divided by the number of sub-characteristic states such that it is possible to reach an average characteristic state as an average across the predefined number of the label rolls.

After said characteristic state has been executed and determined by the detection unit during said determination process, preferably by the detection unit itself, the characteristic state for the container that is to be actually processed is approved. Therefore, only after this is the production process initiated and/or the characteristic state used for one or more processing cycles.

According to at least one embodiment, if a sub-characteristic state determined by the detection unit deviates from an expected value that is uniquely representative of the fitting device, the sub-characteristic state is not taken into account by the detection unit for the determination of the characteristic state.

For example, the expected value in relation to the particular fitting device, for example a label roll, is a value specified by the manufacturer. If the determined sub-characteristic state deviates from the expected value specified by the manufacturer, this means that there is a discrepancy between the measured sub-characteristic state and the expected value. This uncertainty in the determination of the characteristic state and/or of the further characteristic state is therefore eliminated by a fitting device of this kind that has the erroneous expected value not being incorporated into the calculation in advance.

According to at least one embodiment, the further characteristic state is calculated by the detection unit such that a mathematical average of the characteristic state, which has, for example, been determined in advance, and an expected value, preferably not transmitted by the detection unit, in relation to the particular fitting device, are determined or predefined, it being possible to assign the expected value, preferably uniquely, to the particular product and/or the particular fitting device. For example, the expected value is an output fitting amount specified by the manufacturer.

In other words, the further characteristic state differs from the characteristic state in that a further mathematical variable, for example the expected value, has been incorporated into the calculation of the further characteristic state.

As an alternative to the expected value being identified as an amount value that is fixedly predefined by the manufacturer, the expected value may also be implemented as a (future-oriented) predicted expected value. This may mean that various expected values are or have been saved and/or stored in some other manner in the detection unit, and these expected values form the basis for the predicted expected value. The expected value can then be continually redefined during the determination process.

The advantage of the further characteristic state over the characteristic state is therefore that not only characteristic states determined by the detection unit described here are incorporated into the calculation, but rather an expected value from the manufacturer can also be incorporated as a second, for example independent, source.

According to at least one embodiment, a representative signal for a fitting changeover is emitted only on the basis of the further characteristic state, and/or a deviation of the further characteristic state from the characteristic state is determined.

This may mean that, as a result of the calculation of the deviation of the further characteristic state from the characteristic state, the expected value may also be accordingly adjusted and calculated on the basis of said calculated deviation.

According to at least one embodiment, if the further characteristic state deviates from the characteristic state by more than one, the determination of the characteristic state and/or of the further characteristic state is not taken into account, the determination process then starting from the beginning.

This ensures that the information specified, for example by the manufacturer, in relation to the expected value or the predicted expected value is not able to deviate too far from the characteristic values actually determined by the detection unit.

According to at least one embodiment, the detection unit detects a type changeover and subsequently changes the characteristic value, which can be, preferably uniquely, assigned to a particular type, or erases the previous characteristic value, which can be preferably uniquely assigned to the particular type, from a memory of the detection unit.

A type changeover is therefore a changeover, for example, in relation to the containers or also in relation to the type of the product to be supplied. For example, a type changeover is a changeover of bottles in relation to a bottle size or in relation to a filling product.

According to at least one embodiment, the detection device detects, and saves, a changeover of the fitting device, for example a changeover of a label roll, the characteristic state being approved for processing the containers only if a predefinable number of changeover processes in relation to various fitting devices or the same fitting device is exceeded.

In this respect, it is conceivable for the detection unit to decide as of what number, in relation to the changeover of the fitting devices, sufficient reliability can be determined, for example a sufficiently accurate mathematical average of the amount of the product produced per fitting device.

According to at least one embodiment, the fitting device comprises at least one label roll, the product to be supplied being labels. Therefore, as has already been described several times above, in actual fact the fitting device may also be merely a label roll. In this context, it is conceivable for the fitting device to be a labelling machine having two or more label rolls for wrap-around labelling. In this case, a changeover to the second roll (and back) can be carried out automatically. For this purpose, the rolls are adhesively bonded/connected to one other (manual preparation, the adhesive bonding takes place automatically during production). The labels are wrap-around labels and/or self-adhesive labels, for example. Said wrap-around labels can subsequently be shrunk to form shrunk labels.

According to at least one embodiment, a representative signal for a fitting changeover is emitted on the basis of the remaining amount when a predefinable remaining amount minimum number on the current fitting device is reached, and a switch is subsequently made to a different, preferably fully stocked, fitting device (buffer control).

In this embodiment, a switch can therefore be made to a new roll before the end of the label roll. This makes it possible to ensure that the new roll has a sufficient fitting number.

At the end of production, partially spent rolls can be used first when production is next resumed using said type, and therefore production wastage is particularly effectively avoided with respect to overall production using one type.

The following also relates to a device for processing containers. This means that the features specified in relation to above-described methods are also disclosed for the described device, and vice versa.

In the device described here for processing containers, the containers are transported along a predefined transport path and combined with at least one product that can be defined in terms of its amount, such that the product is supplied to each individual container in a predetermined supply region of the transport path, the product being guided to the supply region along a supply path.

In a detection region of the device, which region is arranged along the supply path of the product or upstream of the supply region in a transport direction of the containers, at least one characteristic state which is individually determined, in particular prior to the processing, and/or a further characteristic state can be determined by a detection unit, which characteristic state and/or further characteristic state is representative of an output fitting amount of the product to be supplied in relation to at least one fitting device, and a remaining amount of the product to be supplied, on the fitting device, can be determined on the basis of said characteristic state and/or said further characteristic state during operation, and a representative signal for a fitting changeover can be emitted on the basis of said remaining amount.

The device described here for processing containers has and includes the same advantageous embodiments and advantages as those described in connection with the above-described methods.

Preferably, the supply unit is selected from a group of supply units that includes labelling apparatuses for containers, closure apparatuses for containers, apparatuses for assembling groups of containers or the like.

Further preferably, the device for processing containers is an installation that fits containers with labels. The actual labelling apparatus is, in this case, the above-mentioned supply unit.

However, it would also be conceivable for the device to be an installation that expands preforms to form containers and subsequently fills said containers with a product, such as a beverage.

The following description is with reference to containers that are fitted with labels. However, this is intended to be understood merely by way of example. It is noted that embodiments of the invention may also be applied to containers that are provided with closures, for example, or are also filled with a product, or also to containers that are palletised, and the like. Here the additional product may be either a solid product, such as the mentioned labels, closures or intermediate layers, or a liquid product, such as in particular a beverage to be filled in or some other liquid. It would also be possible to apply the method according to embodiments of the invention to the fitting of container with a plurality of products, i.e. both for fitting with closures and for fitting with labels.

BRIEF DESCRIPTION

Some of the embodiments will be described in detail, with reference to the following FIGURES, wherein like designations denote like members, wherein:

FIG. 1 is a block diagram of a device according to embodiments of the invention.

DETAILED DESCRIPTION

FIG. 1 is a block diagram of a device 1, according to embodiments of the invention, for processing containers 10. The device 1 shown in FIG. 1 is an installation that provides filled bottles with labels. This representation is, however, intended to be understood by way of example and can also be applied to other devices that process or furnish containers in a predefined manner, such as closure devices, filling installations, disinfecting apparatuses and the like.

Reference sign T refers to a transport pathway, along which the containers, already filled in this case, are transported. In an accumulation region 4, a plurality of rows of containers 10 can be transported one next to the other. The arrows shown in FIG. 1 indicate the transport direction. In the embodiment shown in FIG. 1, the containers 10 are carried from a plurality of lanes or from wider lanes to fewer lanes or to narrower lanes, respectively. However, it is also conceivable to arrange the individual lanes in a different manner.

Reference sign 18 denotes a supply portion for the containers that extends between a point A which is located in a detection region 8, and a point B which, in this case, marks the end of the supply portion 18. Preferably, it is known or can be determined how many containers 10 are located in said supply region 18 during working operation. However, it may be sufficient for the number of containers in the supply portion 18 to be known only roughly.

Reference sign 14 refers to a supply unit, said supply unit 14 in this case being a labelling apparatus that supplies labels to the containers 10 or attaches said labels to the containers 10 from a label strip 20 (shown only schematically). Here the labels are supplied to the supply unit 14 from a magazine 16 (also referred to as the fitting device) via a supply path 6. The labels therefore constitute the product described at the outset. Reference sign D denotes the supply region, in which the product is supplied to the containers 10. In this case, the supply region is arranged in the region of the labelling apparatus 14.

According to embodiments of the invention, in the detection region 8, which is arranged along the supply path 6, at least one characteristic state Z which is individually determined, in particular prior to the processing, and/or a further characteristic state Zw is determined by a detection unit 9, which characteristic state Z and/or further characteristic state Zw is representative of an output fitting amount of the product to be supplied in relation to at least one fitting device 16.

A remaining amount M of the product to be supplied, on the fitting device 16, is determined on the basis of said characteristic state Z and/or said further characteristic state Zw during operation, a representative signal for a fitting changeover being emitted on the basis of said remaining amount M.

In other words, the number of labels that are located in the supply path 6 during working operation can therefore be determined in order to carry out a roll changeover in a timely manner. Said value may be an absolute number of labels (for example, an output fitting amount), however, it would also be conceivable for a length of the label strip between the magazine 16 and the supply unit 14 to be defined as the output fitting amount.

If, for example on account of an imminent product changeover, there are no more containers 10 in said detection region 180, this information can be transmitted to the provision unit or the magazine 16. On the basis of the number of containers between points A and B (that has been determined or is still to be determined) and on the basis of the also known number of labels in the supply path 6, the magazine or a controller (the detection unit 9 or the additional detection unit 26, for example) within said magazine can decide when the supply of labels 20 should be interrupted.

The user can thus be advised to cut the label strip at a particular point, for example. Preferably, the region of the labels that is still located in the supply path 6 can then still be attached to the containers 10. In this way, said portion of labels is not wasted and does not have to be removed from the supply path in the event of a product changeover, which is sometimes very time-consuming.

Thus, in a procedure given by way of example, a filling apparatus 2 may also signal an imminent product changeover, and/or transmit a signal that indicates that the filling apparatus is empty, to the labelling apparatus (also referred to as the supply unit) 14 or the magazine 16, or an additional detection unit 26 can, as mentioned, detect a shortage of containers. The magazine can then start to deplete its label store. As soon as a particular minimum is reached, the labelling device 14 preferably reduces its speed in order to minimize the risk of the strip tearing in the event of a malfunction.

However, it would also be possible for another additional detection unit to detect a shortage of containers, i.e. an absence of the containers. Said detection unit is arranged in a region of the transport pathway in which the containers are stood one adjacent to the other in a single lane such that the number of containers between points C and B is known on the basis of the type. In the case of piece-by-piece transportation, the number of containers is known anyway.

Furthermore, it would also be possible, in particular if the method is continued using a different product, for an end portion of a roll, having a kind of label that has just run out or is to be no longer used, to be connected to an initial portion of a roll having a new kind of label, such that production can be continued seamlessly from one type of product to another type of product. This has the advantage that the new label strip does not have to be time-consumingly threaded into the supply path, but is rather fed in, together with the preceding strip, almost automatically. This procedure may also be applied to products that are supplied to the process piece-by-piece, such as pallets. However, in this case, it is not necessary for the old roll to be completely used up, and the new roll may be already partially spent.

It is also possible for a barrier to close on account of the shortage of containers and for the supply unit 14 to terminate the labelling process. In this case, a few remaining labels are preferably left behind in order to compensate for potential failure, in particular of other machine parts. Subsequently, a switch can made to a new product on the supply unit 14, and production can finally be started using the new product.

After the labels 20 have been attached to the containers 10, the containers 10 are transported further along the transport pathway T. Here it is possible for packaging or assembly units to be provided that group the containers. Assembly units of this kind may also be integrated in the installation in the manner according to embodiments of the invention. Thus, it may similarly be signalled to an assembly apparatus of this kind, for example, that a flow of (possibly already labelled) containers 10 has been interrupted and therefore only the containers that are located in a portion 22 are to be provided with a particular packaging material or to be assembled in a particular manner.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

LIST OF REFERENCE SIGNS

A point A
B point B
C point C
D point D/supply region
M remaining amount
T transport path
Z characteristic state
ZA expected value
Zi sub-characteristic state
Zw characteristic state
1 device
4 accumulation region
6 supply path
8 detection region
9 detection unit
10 containers
14 supply unit/labelling apparatus
16 fitting device/magazine
18 supply portion for the containers 10
20 label (strip)
22 portion
26 additional detection unit
180 detection region

The invention claimed is:

1. The method for processing containers, wherein the containers being transported along a predefined transport path and being combined with at least one product that can be defined in terms of its amount, such that the product is supplied to each individual container in a predetermined supply region of the transport path, wherein the product being guided to the supply region along a supply path, comprising, in a detection region, which is arranged along the supply path of the product or upstream of the supply region in a transport direction of the containers, at least one characteristic state which is individually determined, prior to the processing, and/or at least one further characteristic state is determined by a detection unit, which characteristic state and/or further characteristic state is representative of an output fitting amount of the product to be supplied in relation to at least one fitting device, wherein the further characteristic state is calculated by the detection unit such that a mathematical average of the characteristic state and of an expected value, not determined by the detection unit, is determined, it being possible to assign the expected value, uniquely, to the particular product and/or the particular fitting device and wherein a remaining amount of the product to be supplied, on the fitting device, being determined on the basis of said characteristic state and/or said further characteristic state during operation, and a representative signal for a fitting changeover being emitted on the basis of said remaining amount.

2. The method according to claim 1, wherein the characteristic state is determined by the detection unit such that initially, during a determination process, the total amount of the previously produced products for a predefinable number of fitting devices is determined, and a mathematical average of the amount of the product produced per fitting device is subsequently determined in order to thus obtain an output fitting amount per fitting device, and the total amount being determined from a sum of sub-characteristic states of the individual fitting devices.

3. The method according to claim 2, wherein, if a sub-characteristic state determined by the detection unit deviates from an expected value that is uniquely representative of the fitting device, the sub-characteristic state is not taken into account by the detection unit for the determination of the characteristic state.

4. The method according to claim 2, wherein a representative signal for a fitting changeover is emitted only on the basis of the further characteristic state, and/or in that a deviation of the further characteristic state from the characteristic state is determined.

5. The method according to claim 2, wherein if the further characteristic state deviates from the characteristic state by more than one, the determination of the characteristic state and/or of the further characteristic state is not taken into account and the determination process starts from the beginning.

6. The method according to claim 2, wherein the detection unit detects a type changeover and subsequently changes the characteristic value, which can be assigned, to a particular type, or erases the previous characteristic value from a memory of the detection unit.

7. The method according to claim 2, the detection unit detects, and saves, a changeover of the fitting device, and the characteristic state being approved for processing the containers only if a predefinable number of changeover processes in relation to various fitting devices is exceeded.

8. The method according to claim 2, wherein the fitting device comprises at least one label roll, and the product to be supplied is labels.

9. The method according to claim 2, wherein the labels are wrap-around labels and/or self-adhesive labels.

10. The method according to claim 2, wherein a representative signal for a fitting changeover is emitted on the basis of the remaining amount when a predefinable remaining amount minimum number on the current fitting device is reached, and a switch is subsequently made to a different, fully stocked, fitting device.

11. A device for processing containers, wherein the containers can be transported along a predetermined transport path and can be combined with at least one product that can be defined in terms of its amount, such that the product is supplied to each individual container in a predetermined supply region of the transport path, the product being guided to the supply region along a supply path, wherein in a detection region, which is arranged along the supply path of the product or upstream of the supply region in a transport direction of the containers, at least one characteristic state which is individually determined, prior to the processing, and/or one further characteristic state can be determined by a detection unit, which characteristic state and/or further characteristic state is representative of an output fitting amount of the product to be supplied in relation to at least one fitting device, wherein the detection device is configured to calculate the further characteristic state such that a mathematical average of the characteristic state and of an expected value, not determined by the detection unit, is determined, it being possible to assign the expected value, uniquely, to the particular product and/or the particular fitting device, wherein the detection unit includes a memory apparatus and wherein it being possible to determine a remaining amount of the product to be supplied, on the fitting device, on the basis of said characteristic state and/or said further characteristic state during operation, and it being possible to emit a representative signal for a fitting changeover on the basis of said remaining amount.

* * * * *